US011547890B2

(12) United States Patent
Stewart

(10) Patent No.: US 11,547,890 B2
(45) **Date of Patent: *Jan. 10, 2023**

(54) RESISTANCE-BASED EXERCISE DEVICE

(71) Applicant: Christopher S. Stewart, Santa Monica, CA (US)

(72) Inventor: Christopher S. Stewart, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/393,913

(22) Filed: Apr. 24, 2019

(65) Prior Publication Data

US 2019/0329084 A1 Oct. 31, 2019

Related U.S. Application Data

(60) Provisional application No. 62/662,641, filed on Apr. 25, 2018.

(51) Int. Cl.
*A63B 21/04* (2006.01)
*A63B 21/055* (2006.01)
*A63B 21/00* (2006.01)

(52) U.S. Cl.
CPC ..... *A63B 21/0407* (2013.01); *A63B 21/0557* (2013.01); *A63B 21/4035* (2015.10); *A63B 21/4043* (2015.10)

(58) Field of Classification Search
CPC ..... A63B 21/0407; A63B 21/0557; A63B 21/4043; A63B 21/4035; A63B 21/00061; A63B 21/0724; A63B 21/0414; A63B 23/03525; A63B 21/0442; A63B 2071/027
See application file for complete search history.

(56) References Cited

U.S. PATENT DOCUMENTS 4,618,142 A * 10/1986 Joseph, Jr. ..... A63B 5/20 482/106
5,531,657 A * 7/1996 Macedo ..... A63B 21/0084 482/106
5,588,942 A * 12/1996 Dillard ..... A63B 21/4035 482/106
5,891,004 A * 4/1999 Berry ..... A63B 21/04 482/106
6,241,644 B1 * 6/2001 Tepperberg ..... A63B 21/0004 482/121
6,648,804 B2 * 11/2003 Chen ..... A63B 21/0004 482/125
7,198,591 B2 * 4/2007 Lien ..... A63B 21/0728 482/106
7,201,711 B2 * 4/2007 Towley, III ..... A63B 21/0605 482/106
7,326,157 B2 * 2/2008 Wu ..... A63B 21/0004 482/121
7,465,259 B2 * 12/2008 Mok ..... A63B 21/0004 482/121
7,578,775 B2 * 8/2009 Terry ..... A63B 21/0004 482/121

(Continued)

*Primary Examiner* — Garrett K Atkinson
(74) *Attorney, Agent, or Firm* — Milord A. Keshishian

(57) ABSTRACT

A resistance-based exercise device comprised a bar with a first engagement plate fixed to its first distal end and a second engagement plate fixed to its second distal end. The first and the second engagement plates have one or more openings for detachably engaging one or more resistance bands of varying resistance level by a coupler.

7 Claims, 20 Drawing Sheets

(56) References Cited

U.S. PATENT DOCUMENTS 7,922,634 B1 * 4/2011 Wu ..... A63B 23/03525 482/126
8,079,942 B2 * 12/2011 Anderson ..... F41B 5/1476 482/121
8,506,460 B2 * 8/2013 Seitzer ..... A63B 21/065 482/106
8,585,563 B2 * 11/2013 Wilson ..... A63B 21/0724 482/93
8,905,902 B2 * 12/2014 Burcham ..... A63B 21/151 482/123
9,005,088 B2 * 4/2015 Sides, Jr. ..... A63B 21/4005 482/107
9,126,079 B2 * 9/2015 Jordan ..... A63B 21/072
9,254,405 B1 * 2/2016 Marji ..... A63B 21/02
9,409,220 B2 * 8/2016 Henniger ..... B21D 53/36
9,597,541 B2 * 3/2017 Hinds ..... A63B 21/16
9,713,734 B1 * 7/2017 Hurlbut ..... A63B 23/12
9,839,805 B2 * 12/2017 Demarco ..... A63B 21/0557
9,884,239 B2 * 2/2018 Kay ..... A63B 24/0087
9,919,176 B2 * 3/2018 Christie ..... A63B 23/03525
10,226,136 B2 * 3/2019 Cohn ..... A47D 13/04
10,532,241 B2 * 1/2020 Boatner ..... A63B 21/0724
2002/0198081 A1 * 12/2002 Chen ..... A63B 21/00043 482/23
2004/0077466 A1 * 4/2004 Wallace ..... A63B 21/072 482/93
2005/0107226 A1 * 5/2005 Monda ..... A63B 21/04 482/121
2007/0287614 A1 * 12/2007 Fuller ..... A63B 21/169 482/121
2008/0280738 A1 * 11/2008 Brennan ..... A63B 23/03525 482/129
2009/0275449 A1 * 11/2009 Terry ..... A63B 23/03525 482/139
2010/0152002 A1 * 6/2010 Knight ..... A63B 21/0552 482/93
2011/0028288 A1 * 2/2011 Anderson ..... A63B 23/1209 482/124
2014/0018214 A1 * 1/2014 Jordan ..... A63B 21/0722 482/107
2014/0038793 A1 * 2/2014 Hetzel ..... A63B 23/0355 482/122
2014/0119811 A1 * 5/2014 Henniger ..... B21D 5/16 403/187
2014/0200119 A1 * 7/2014 Sides, Jr. ..... A63B 21/0724 482/106
2016/0144221 A1 * 5/2016 Wallander ..... A63B 21/055 482/106
2016/0263461 A1 * 9/2016 Kay ..... A63B 24/0087

* cited by examiner

RESISTANCE-BASED EXERCISE DEVICE

CROSS-REFERENCE TO RELATED APPLICATIONS

This application claims the benefit of priority of co-pending U.S. Utility Provisional Patent Application 62/662,641, filed Apr. 25, 2018, the entire disclosure of which is expressly incorporated by reference in its entirety herein.

All documents mentioned in this specification are herein incorporated by reference to the same extent as if each individual document was specifically and individually indicated to be incorporated by reference.

It should be noted that throughout the disclosure, where a definition or use of a term in any incorporated document(s) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention are related to an exercise device, and more particularly, to resistance-based exercise device that uses resistance bands.

Description of Related Art

Conventional exercise devices using resistance bands are well known and have been in use for a number of years. They are also known as elastic, elongation, or rubber, bands. Regrettably, most are complex to assemble and are manufactured with many parts.

Some conventional resistance-based exercise devices require use of proprietary resistance bands that are specifically manufactured for a particular exercise device. In other words, any commercially available third-party resistance bands cannot be used with the specific exercise device.

Still other conventional resistance-based exercise devices limit the number and type of resistance bands that may be used with the exercise device for a particular exercise routine. For example, they may have one resistance band fixed to the exercise device with a specific maximum limit of resistance level only.

Further, other conventional resistance-based exercise devices require that the resistance band be fixed (and not detachable) to the exercise device and hence, limit the type of exercise routines (and range of motion) that may be performed and also, limit the type and the maximum workout that may be performed with the exercise device.

Accordingly, in light of the current state of the art and the drawbacks to current resistance-based exercise devices and methods thereof mentioned above, a need exists for a very simple exercise device that would allow for quick and easy detachable engagement of commercially available resistance bands of different types, sizes, numbers, and resistance levels. Additionally, a need exists for an exercise device that would have detachable resistance bands that would not hinder and limit the type of exercise routine (and range of motion) and the maximum workout that may be performed with the exercise device.

BRIEF SUMMARY OF THE INVENTION

A non-limiting, exemplary aspect of an embodiment of the present invention provides a resistance-based exercise device (e.g., compact barbell), comprising:

a single, integral piece having:

a bar having a first distal end and a second distal end;

a first engagement plate fixed to the first distal end; and a second engagement plate fixed to the second distal end;

wherein: the first and the second engagement plates have one or more openings for detachably engaging one or more resistance bands of varying resistance level by a coupler.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

One or more embodiments of the present invention provide a very simple resistance-based exercise device that allow for quick and easy attachment and detachment of most commercially available resistance bands of different varieties (e.g., different types, sizes, numbers, resistance levels, and etc.).

Further, one or more embodiments of the present invention provide a resistance-based exercise device with detachable resistance bands that does not hinder and limit the type of exercise routine (and range of motion) and the maximum workout that may be performed with the exercise device.

FIGS. 1A to 1K are non-limiting, exemplary illustration of a resistance-based exercise device and non-limiting, exemplary set of exercise routines performed using the resistance-based exercise device in accordance with one or more embodiments of the present invention. It should be noted that only a few, non-limiting, exemplary set of exercises routines are shown for illustration and discussion purposes.

Figure 1A:
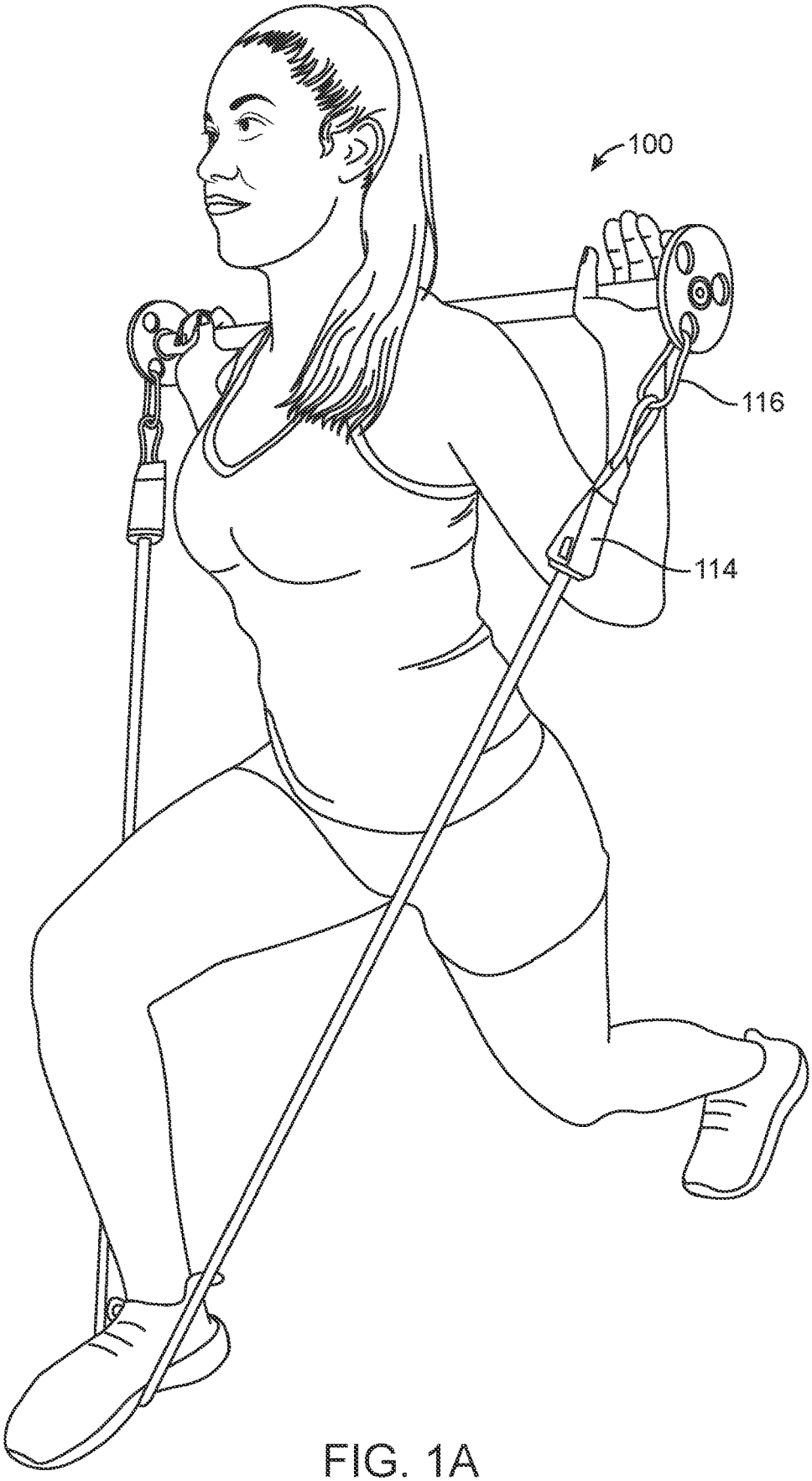
FIGS. 1A to 1K are non-limiting, exemplary illustration of a resistance-based exercise device and non-limiting, exemplary set of exercise routines performed using the resistance-based exercise device in accordance with one or more embodiments of the present invention.
Figure 1B:
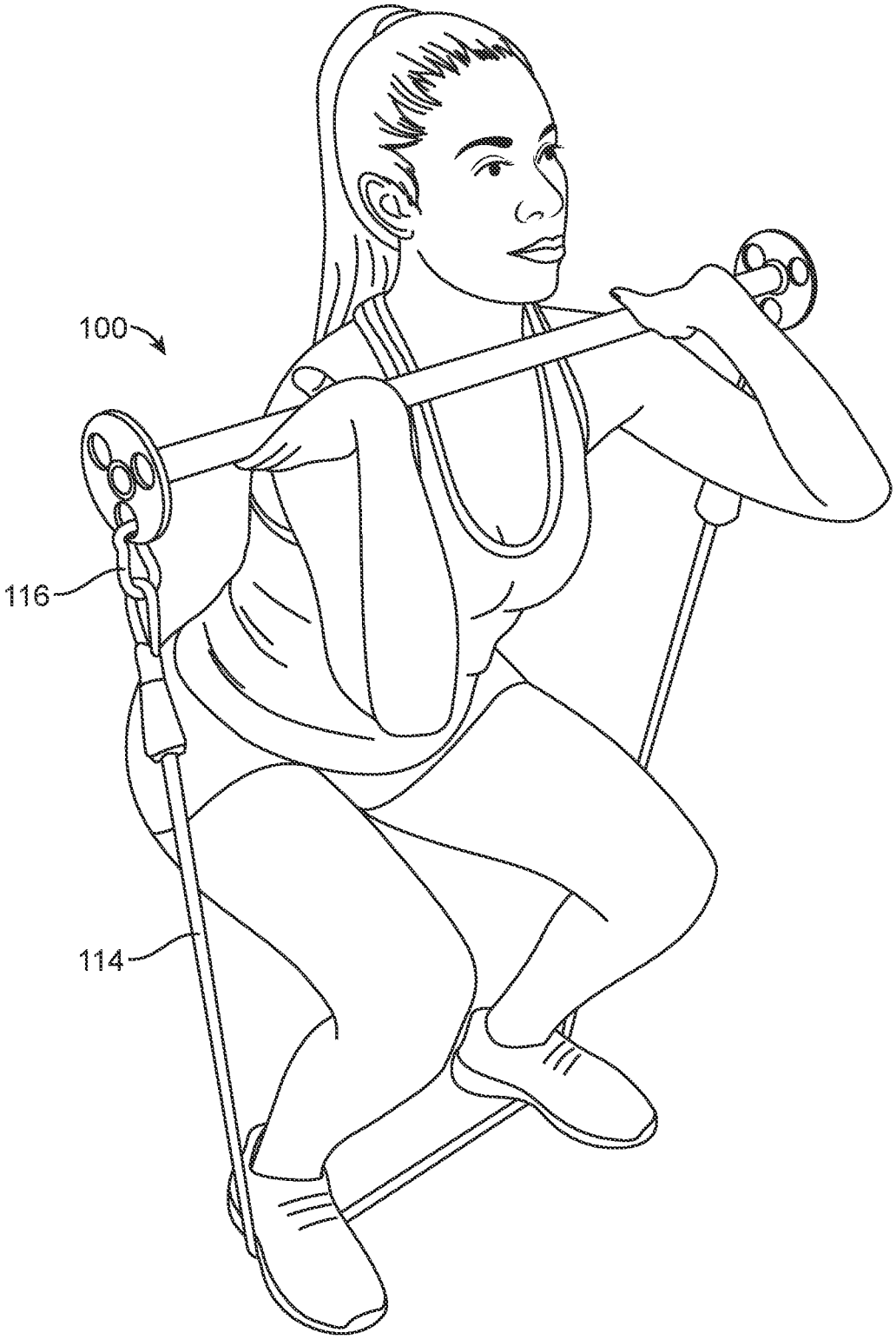
Figure 1C:
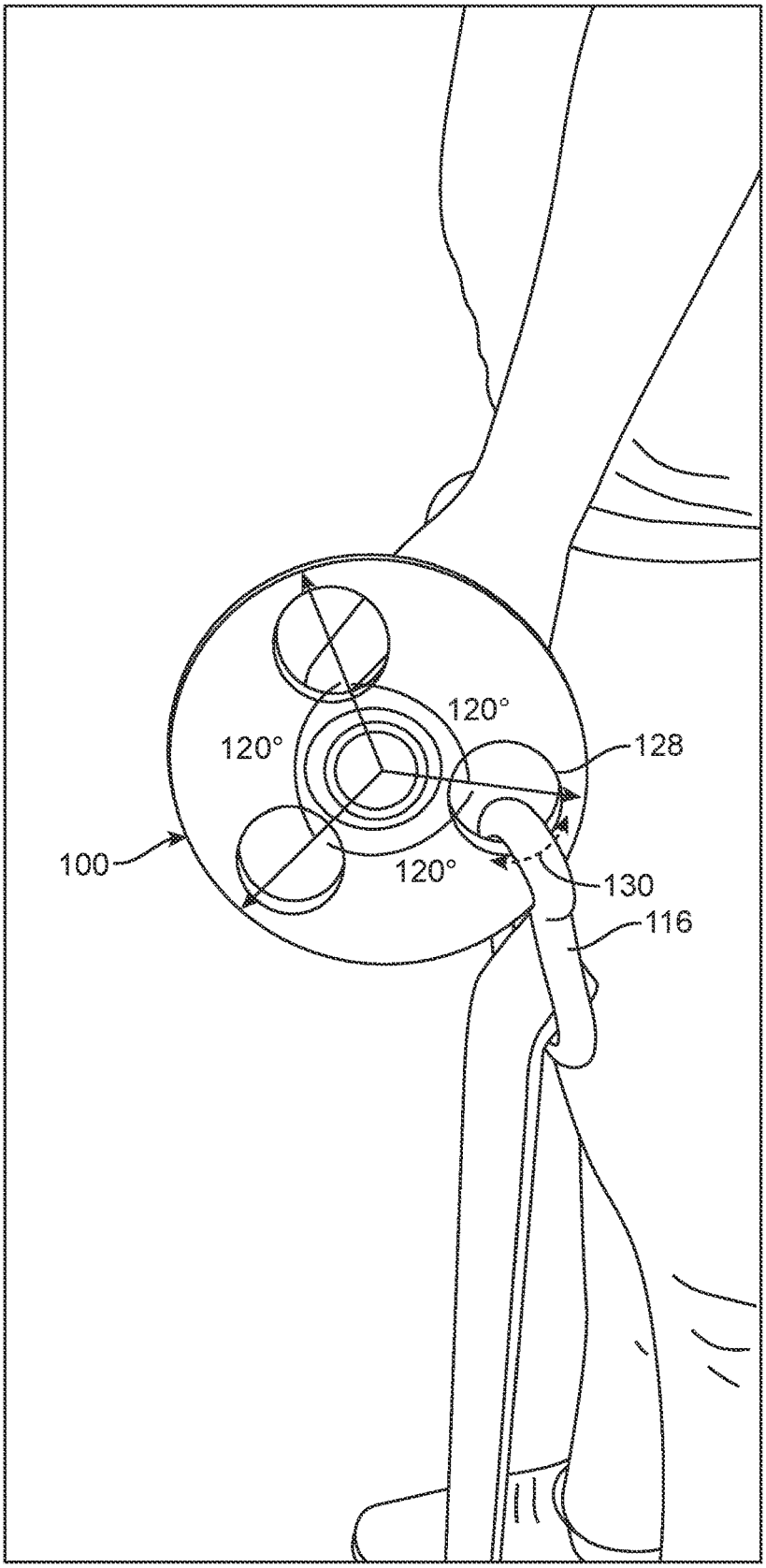
Figure 1D:
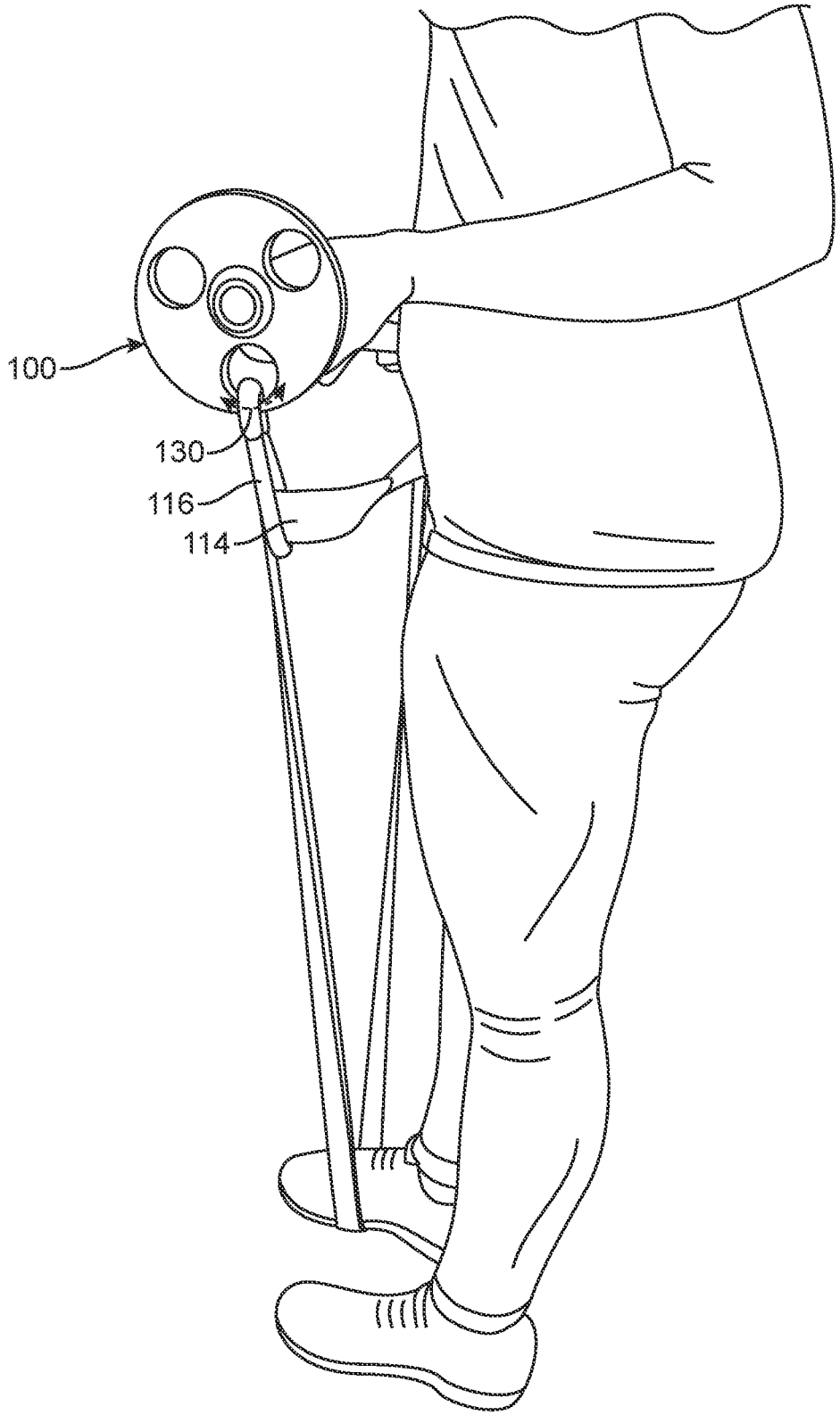
Figure 1E:
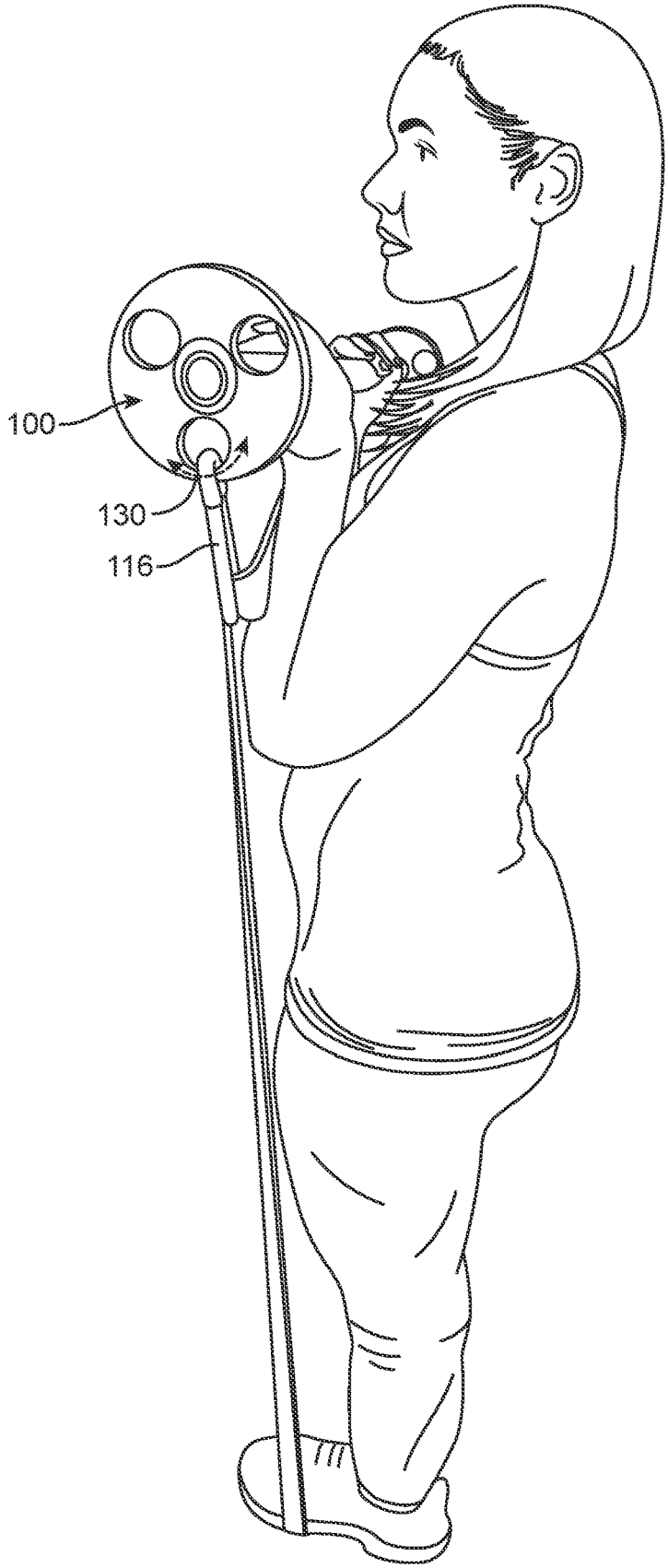
Figure 1F:
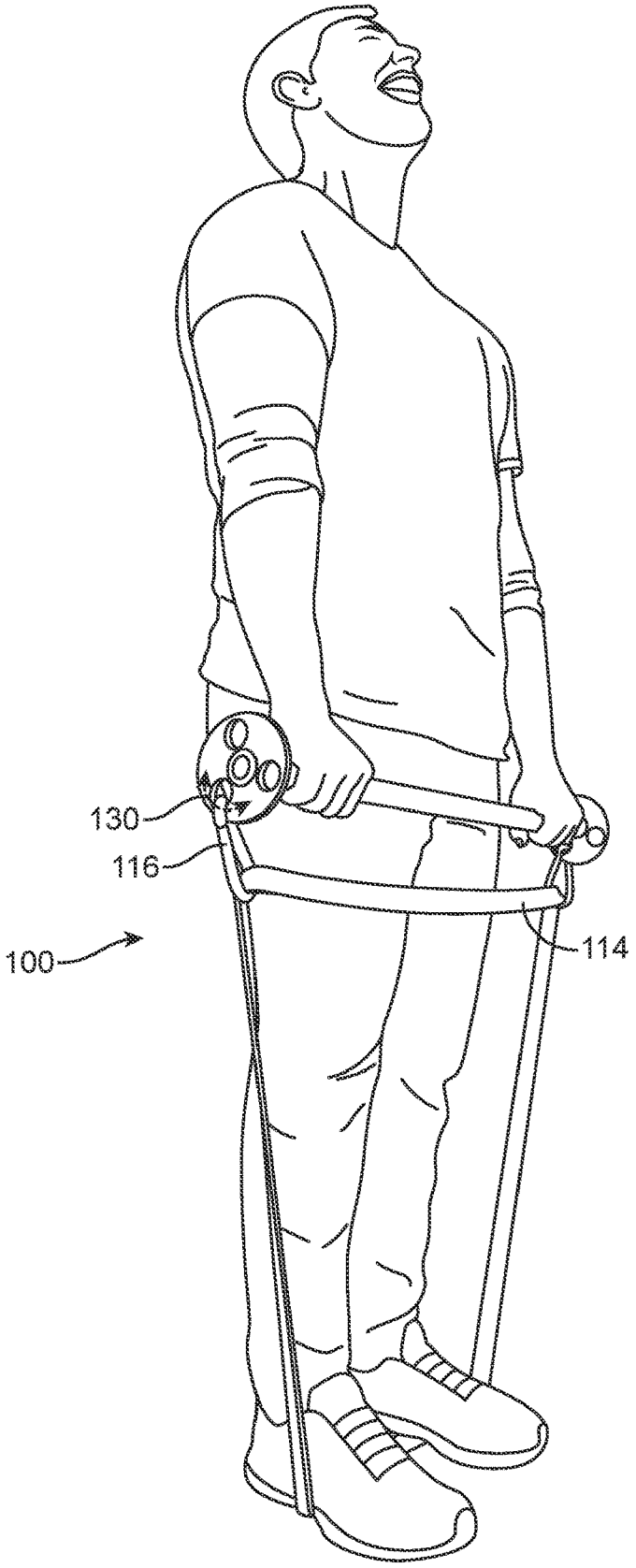
Figure 1G:
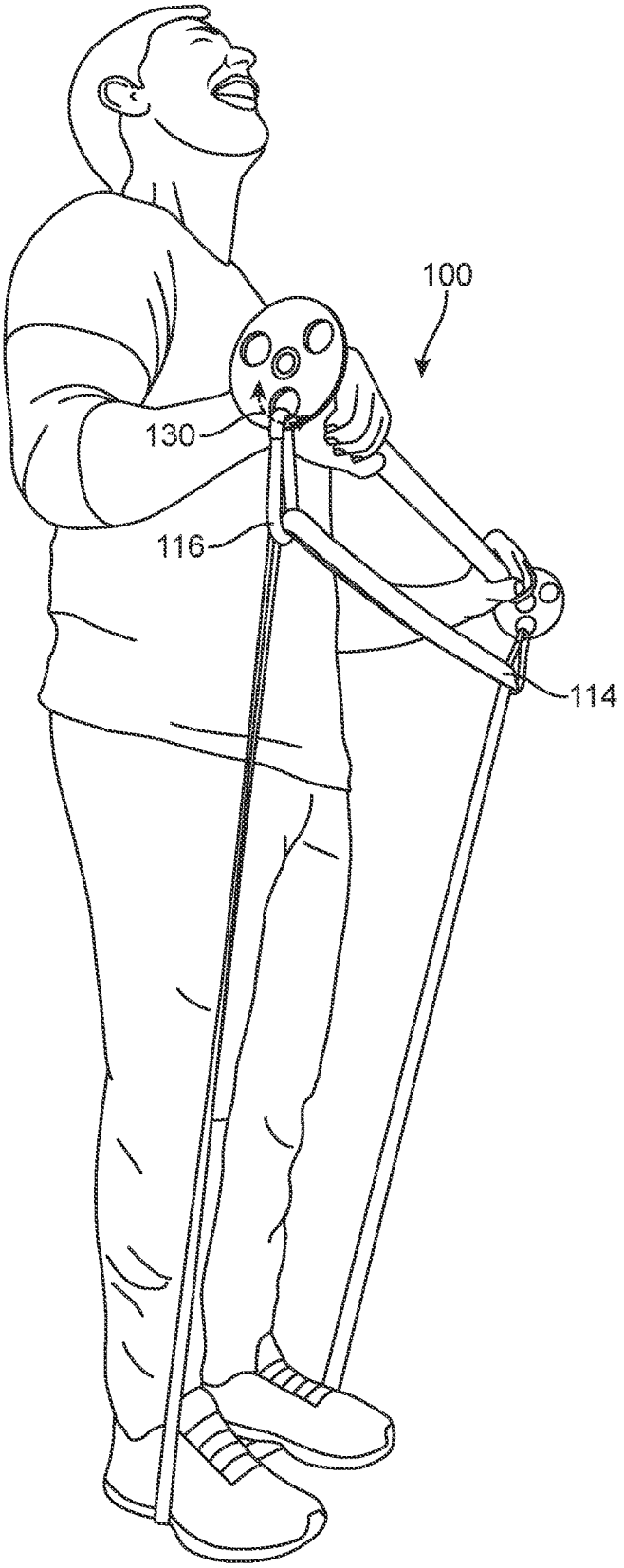
Figure 1H:
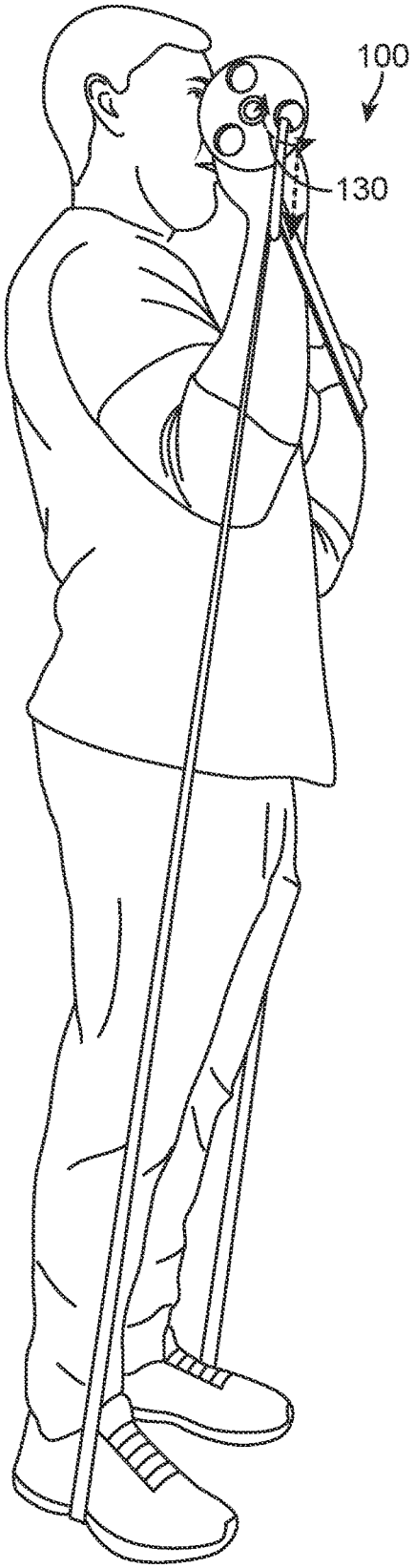
Figure 1I:
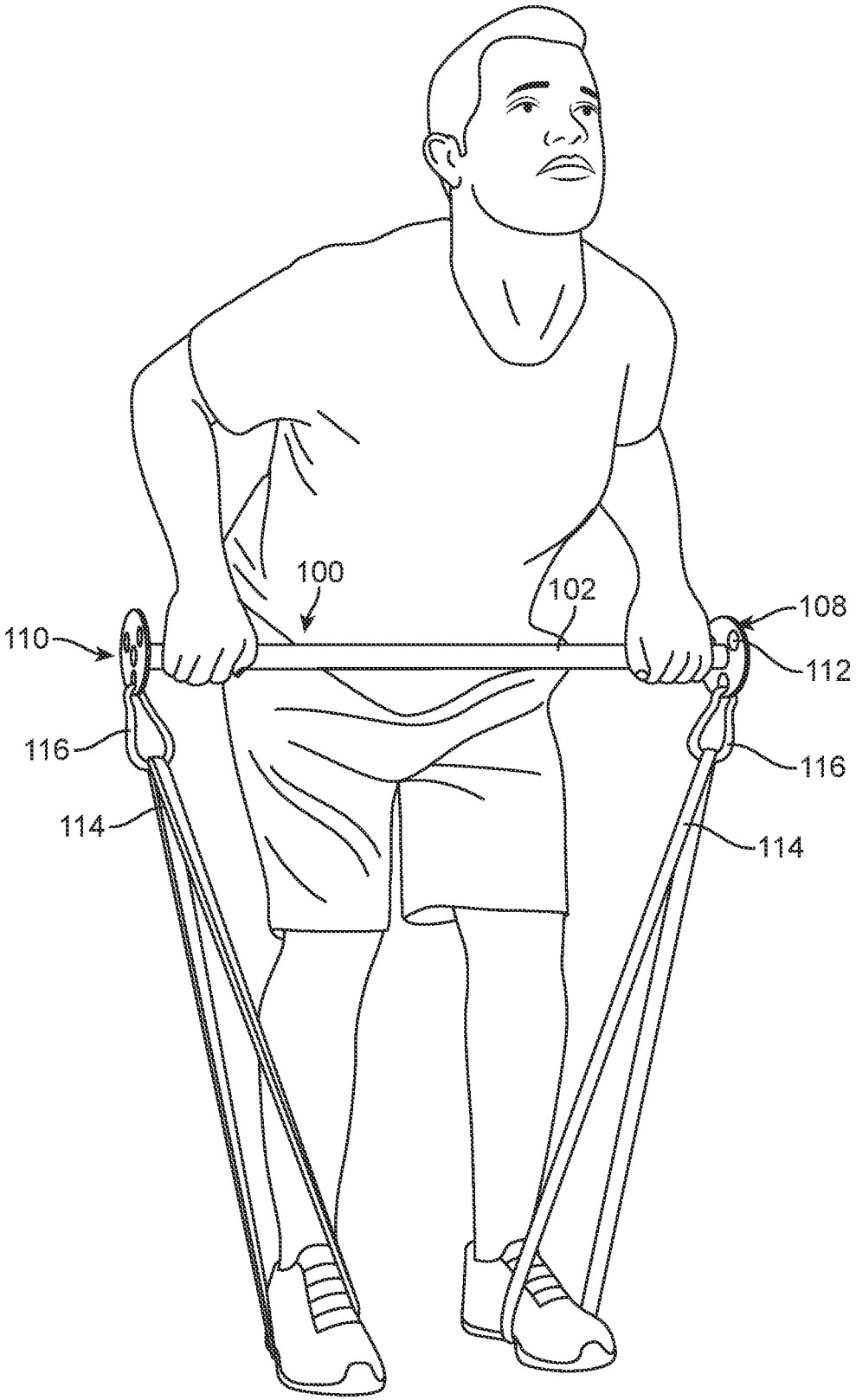
Figure 1J:
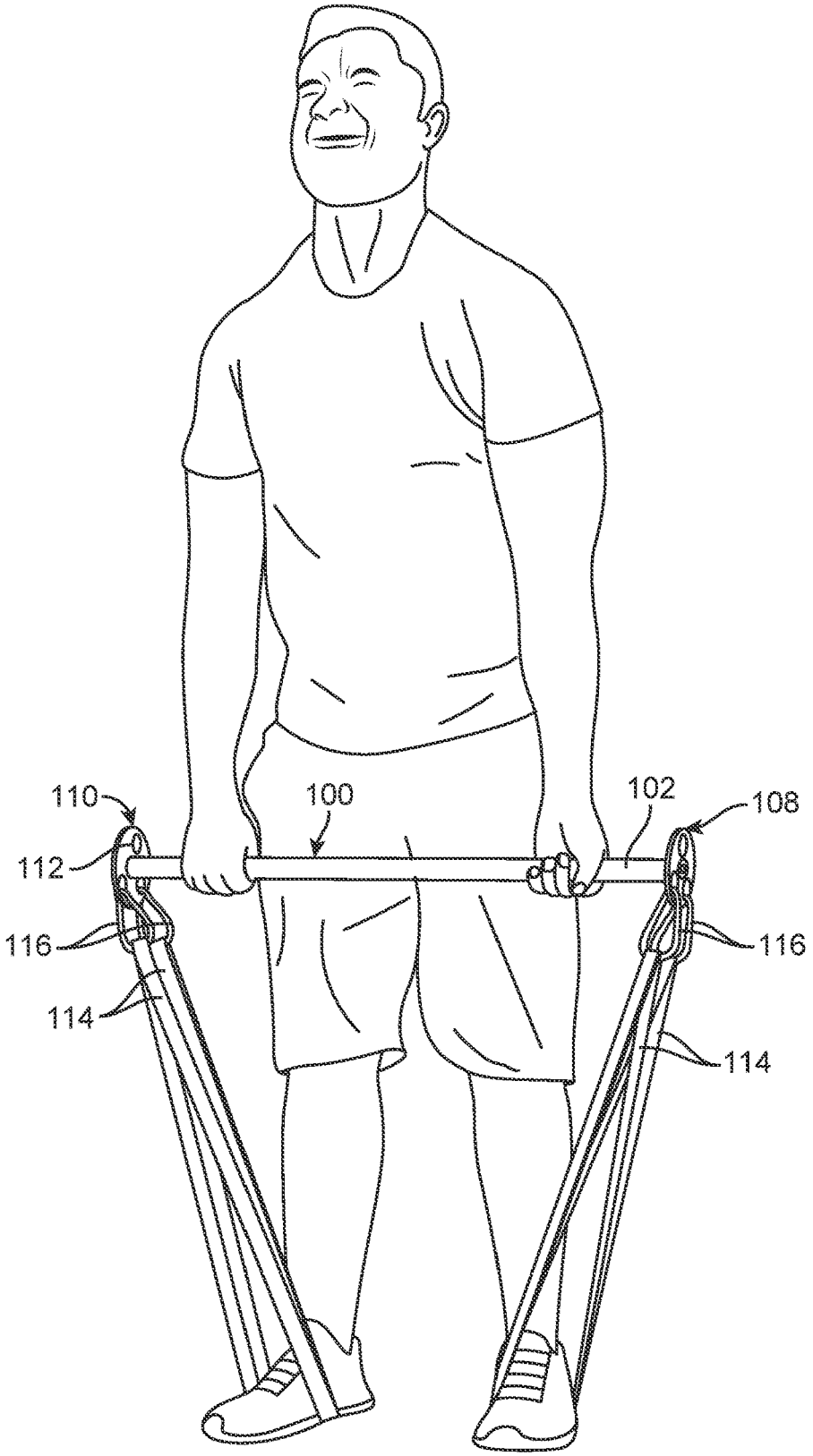
Figure 1K:
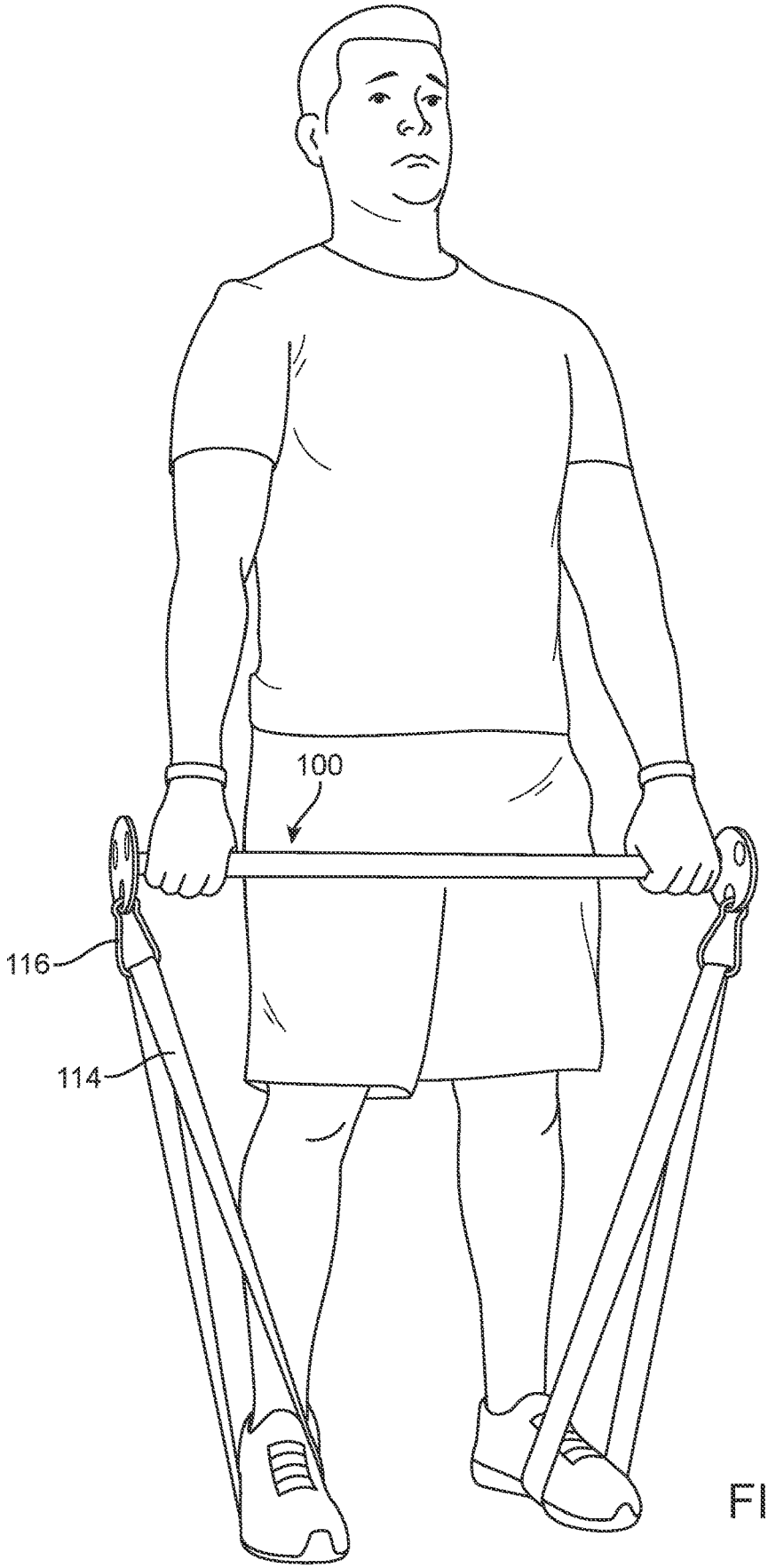

As illustrated in FIGS. 1A to 1K, resistance-based exercise device 100 may be used to perform a large number of different types of exercise routine from simple leg plunge (FIG. 1A) to simple lifts (FIG. 1B). Others may include well-known exercise routines such as regular bicep curls (FIGS. 1C to 1E), and overhand bicep curls (FIGS. 1F to 1H). Still others may include dead-lifts (FIGS. 11 to 1K).

Figure 2:
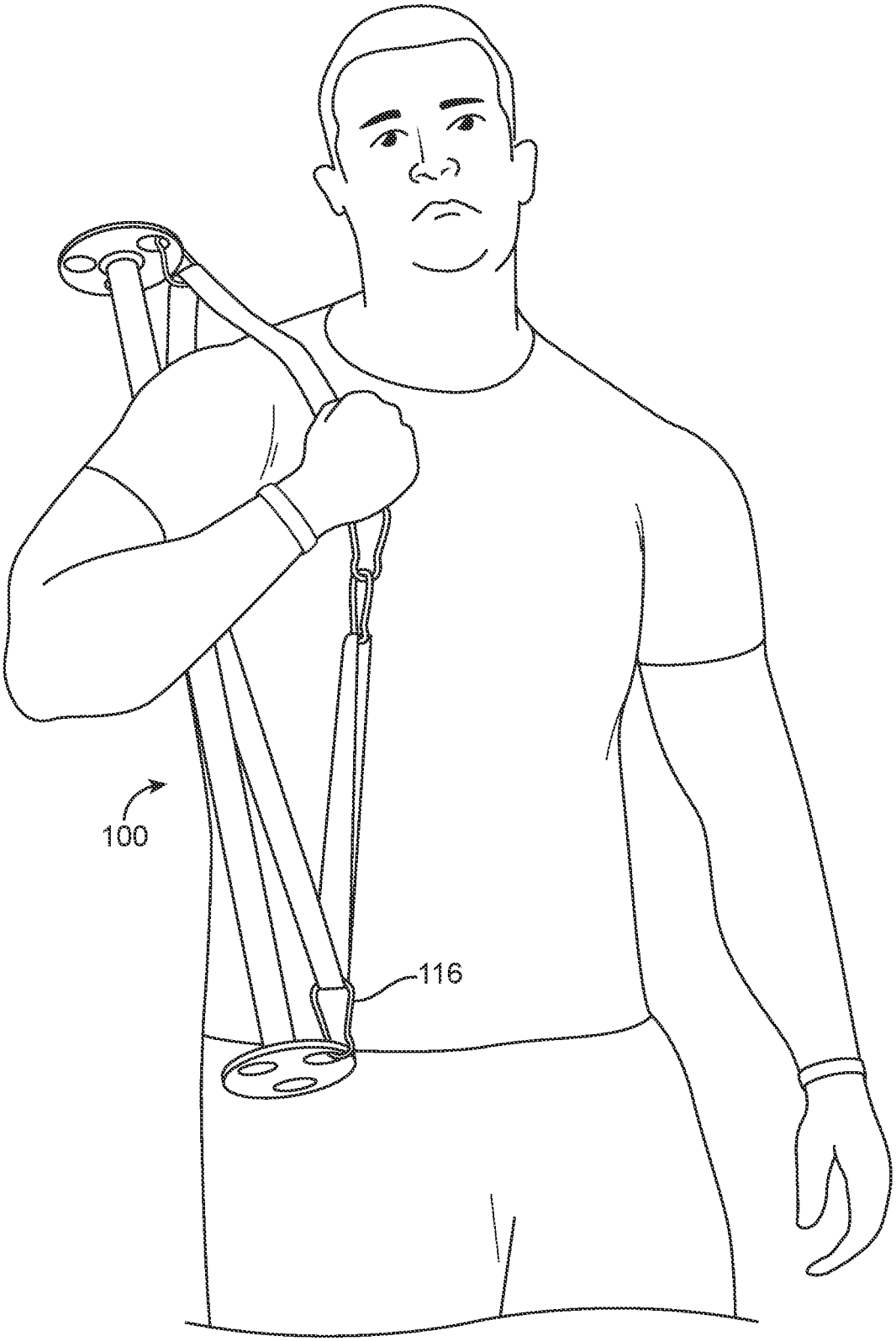
FIG. 2 is a non-limiting, exemplary illustration of the resistance-based exercise device shown in FIGS. 1A to 1K, showing a non-limiting, exemplary method of carrying the resistance-based exercise device in accordance with one or more embodiments of the present invention.

FIG. 2 is a non-limiting, exemplary illustration of the resistance-based exercise device shown in FIGS. 1A to 1K, showing a non-limiting, exemplary method of carrying the resistance-based exercise device in accordance with one or more embodiments of the present invention. As illustrated and further detailed below, resistance-based exercise device 100 has a compact form-factor that may be easily carried by a user and stored, with or without resistance bands. In general, resistance-based exercise device 100 may comprise of a rigid metal such as steel or any other conventional material used in manufacturing conventional weightlifting barbells.

FIGS. 3A to 3H are non-limiting, exemplary illustration of the resistance-based exercise device shown in FIGS. 1A to 1K in accordance with one or more embodiments of the present invention. As shown in FIGS. 1A to 3H, resistance-based exercise device 100 is comprised of a single, integral piece comprised of an elongated cylindrical bar 102 having a first distal end 104 and a second distal end 106. In this non-limiting, exemplary instance, first and second distal ends 104 and 106 may be identical.

Resistance-based exercise device 100 further includes a first engagement plate 108 fixed to first distal end 104, and a second engagement plate 110 fixed to second distal end 106. In this non-limiting, exemplary instance, first and second engagement plates 108 and 110 may be identical and may be welded to bar 102.

First engagement plate 108 and second engagement plate 110 are comprised of a flat, rounded piece configured as a disk. First engagement plate 108 and second engagement plate 110 are oriented perpendicular a longitudinal axis 118 of bar 102. In other words, first engagement plate 108 and second engagement plate 110 are parallel, with orientation of one or more openings 112 perpendicular to longitudinal axis 118 of bar 102.

Use of engagement plates 108 and 110 rather than simple O-rings for example that may be connected to distal ends 104 and 106 of bar 102 improves the overall structural integrity of the resistance-based exercise device 100, especially at points where the greatest force is experienced by Resistance-based exercise device 100. Additionally, use of engagement plates 108 and 110 simplifies overall manufacturing by providing only single weld-point per distal end 104 and 106 of bar 102.

Further, as shown in FIGS. 1A to 3H, first and second engagement plates 108 and 110 have one or more openings (through-openings) 112 for detachably engaging one or more resistance bands 114 of varying resistance levels by one or more couplers 116. Non-limiting examples of couplers 116 may be for example, carabiners (as shown), clips, etc. It should be noted that the resistance bands 114 and couplers 116 are conventional, commercially available components.

First engagement plate 108 and second engagement plate 110 are disks, with each disk having a center 120 fixed to first and second distal ends 104 and 106 of bar 102, and with one or more openings 112 surrounding center 120. One or more openings 112 are disposed on first and second engagement plates 108 and 110, between center 120 and peripheral edge 122.

An opening of one or more openings 112 on first and second engagement plates 108 and 110 is disposed equally from a next opening of one or more openings 112 on engagement plates 108 and 110. An opening of the one or more openings 112 is round with a first diameter 124, and a next opening of the one or more openings is round with a second diameter 126. It should be noted that first and second diameters 124 and 126 of the opening and next opening are preferably equal.

As best illustrated in FIGS. 1C to 1H, coupler 116 detachably engaged with an opening of the one or more openings 112 freely slides within the opening during a range of motion of exercise. Coupler 116 at the engagement site attached within an opening of the engagement plate 108/110 must have free movement during a range of motion of exercise so to not hinder, obstruct, or prevent proper execution of the exercise routine, which is the reason for rounded openings 112.

Accordingly, rounded openings enable coupler 116 to maneuver smoothly and freely (as shown by arrows 130) within the rounded opening, moving along inner circumferential periphery 128 of the rounded opening (the full 360 degrees of circular opening 112) during a range of motion of an exercise routine. Accordingly, fully circular or rounded configuration of openings 112 is important for smooth, unhindered, and continuous movement of coupler 116 during a range of motion of an exercise routine. Otherwise, coupler 116 will be stopped at a vertex of inner periphery of an opening that is not fully rounded or circular, but is polygonal (even if partially, e.g., semi-circle). This is especially essential for all exercise routines where the exercise device is not directly positioned over the feet, for example, bicep curls shown in FIGS. 1C to 1H. The range of movement of resistance based exercise device 100 through this well-known exercise would force couplers 116 to also move along within the rounded openings as progressively shown in FIGS. 1C to 1H otherwise, the exercise routine cannot be performed properly, forcing users to curl their wrist to continue the motion to completion, while the coupler 116 may be stuck within a vertex of a non-rounded or non-circular opening.

Figure 3A:
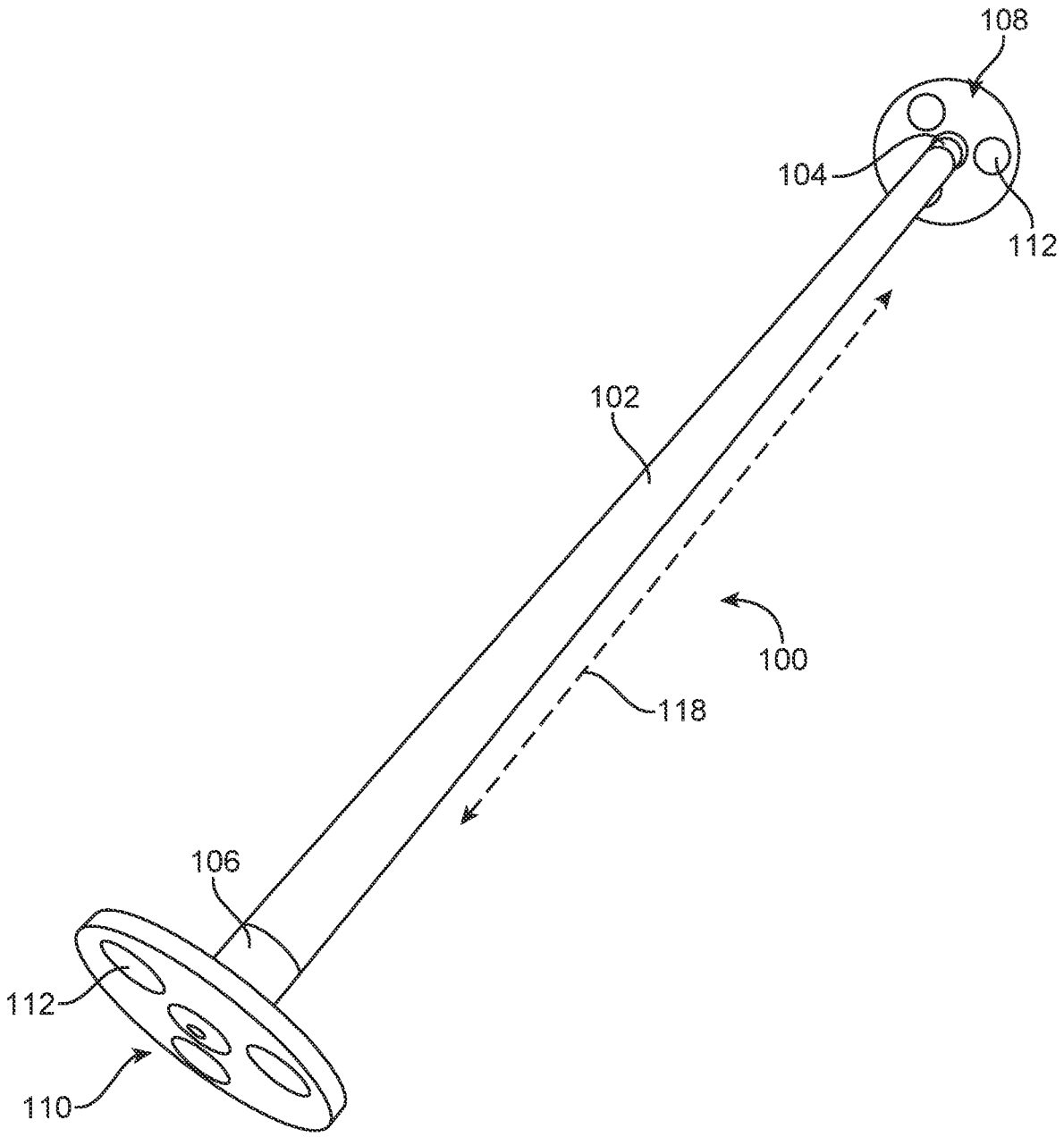
FIGS. 3A to 3H are non-limiting, exemplary illustration of the resistance-based exercise device shown in FIGS. 1A to 1K in accordance with one or more embodiments of the present invention.
Figure 3B:
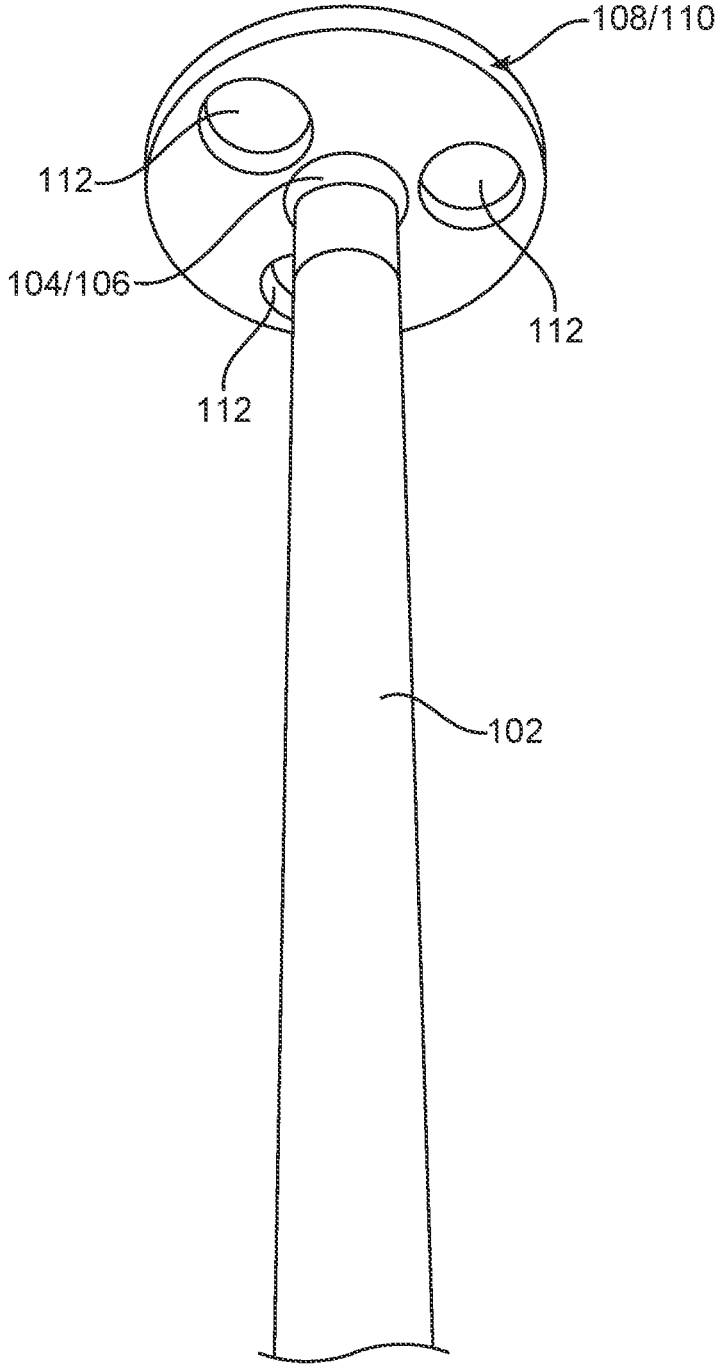
Figure 3C:
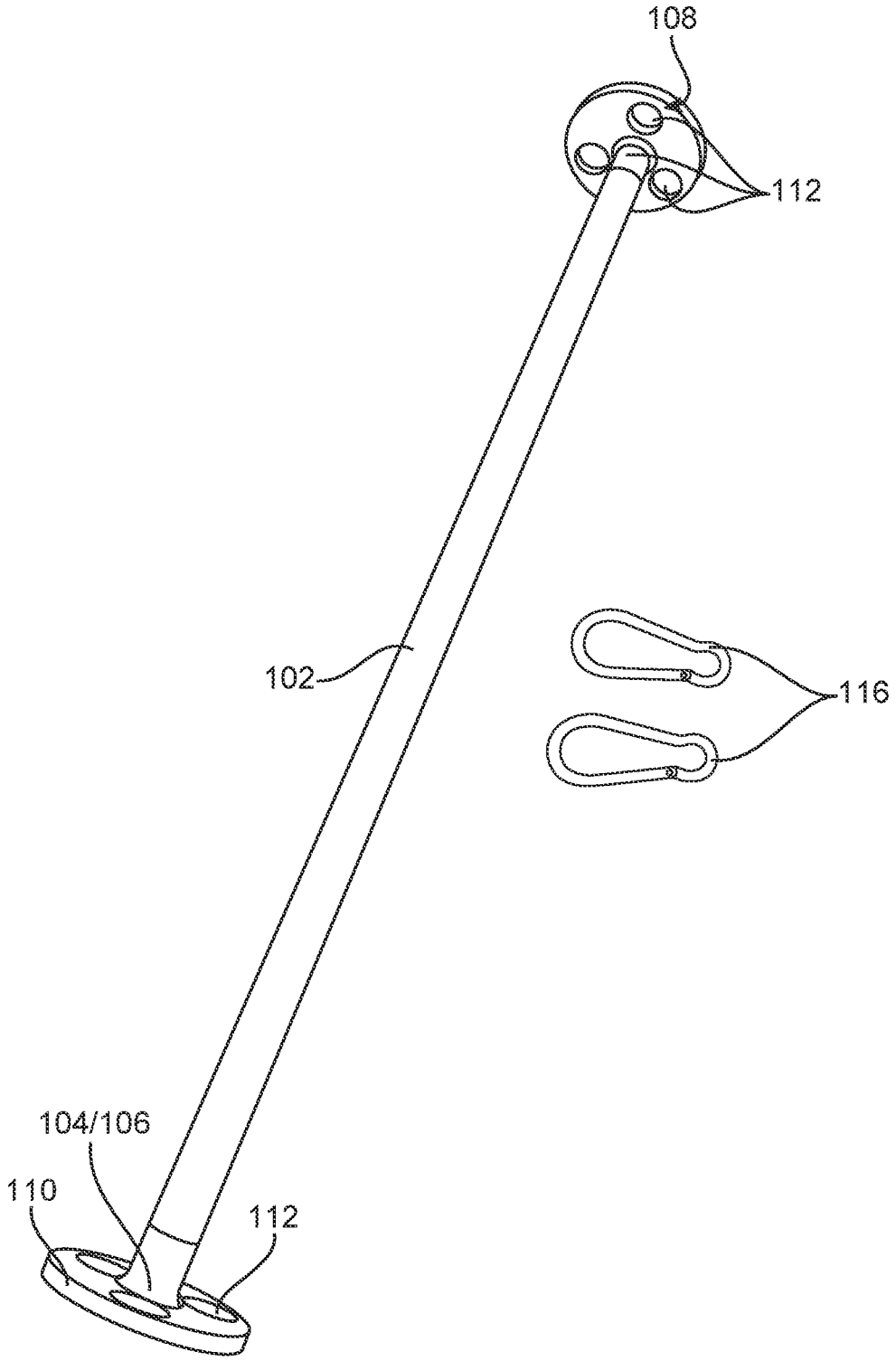
Figure 3D:
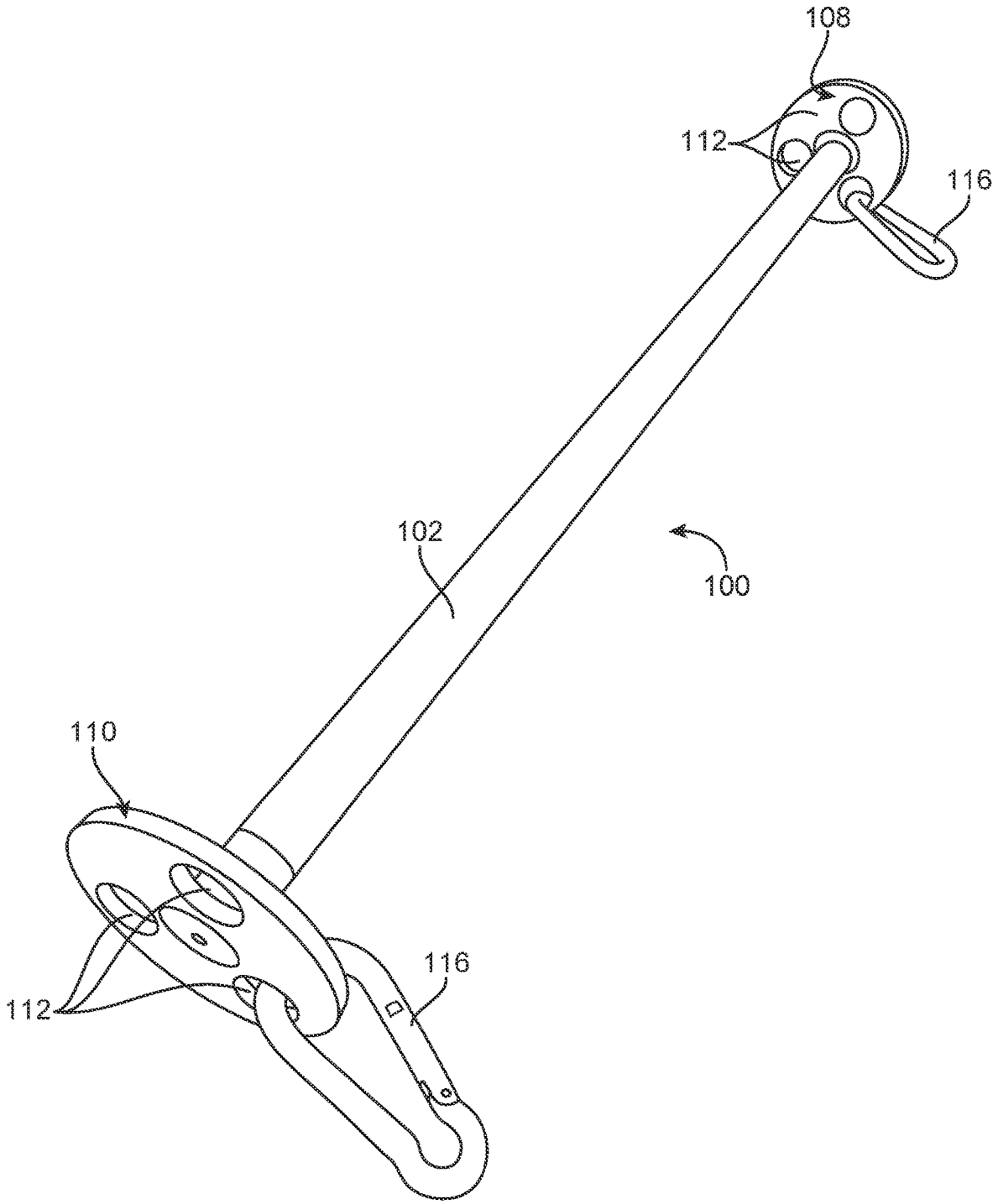
Figure 3E:
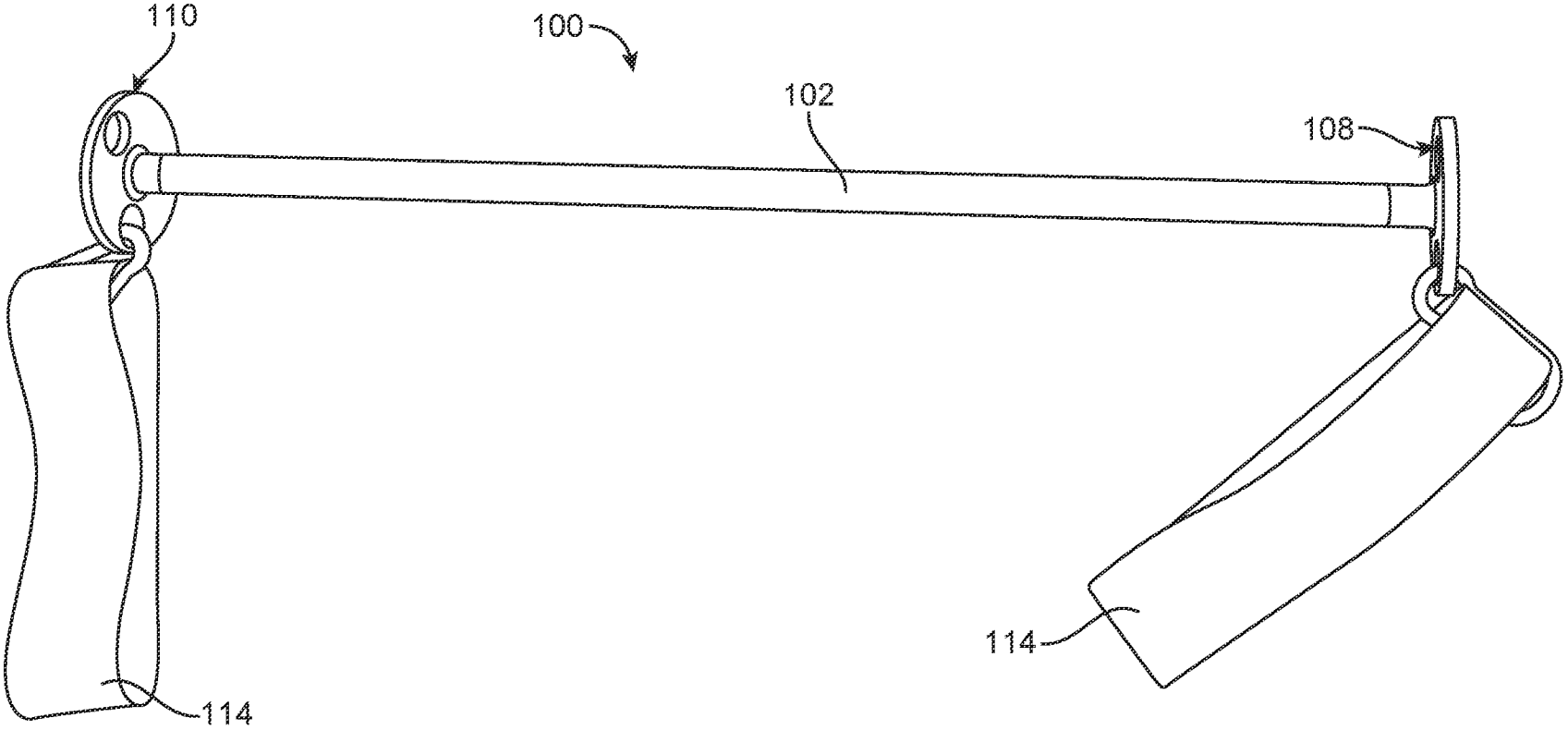
Figure 3F:
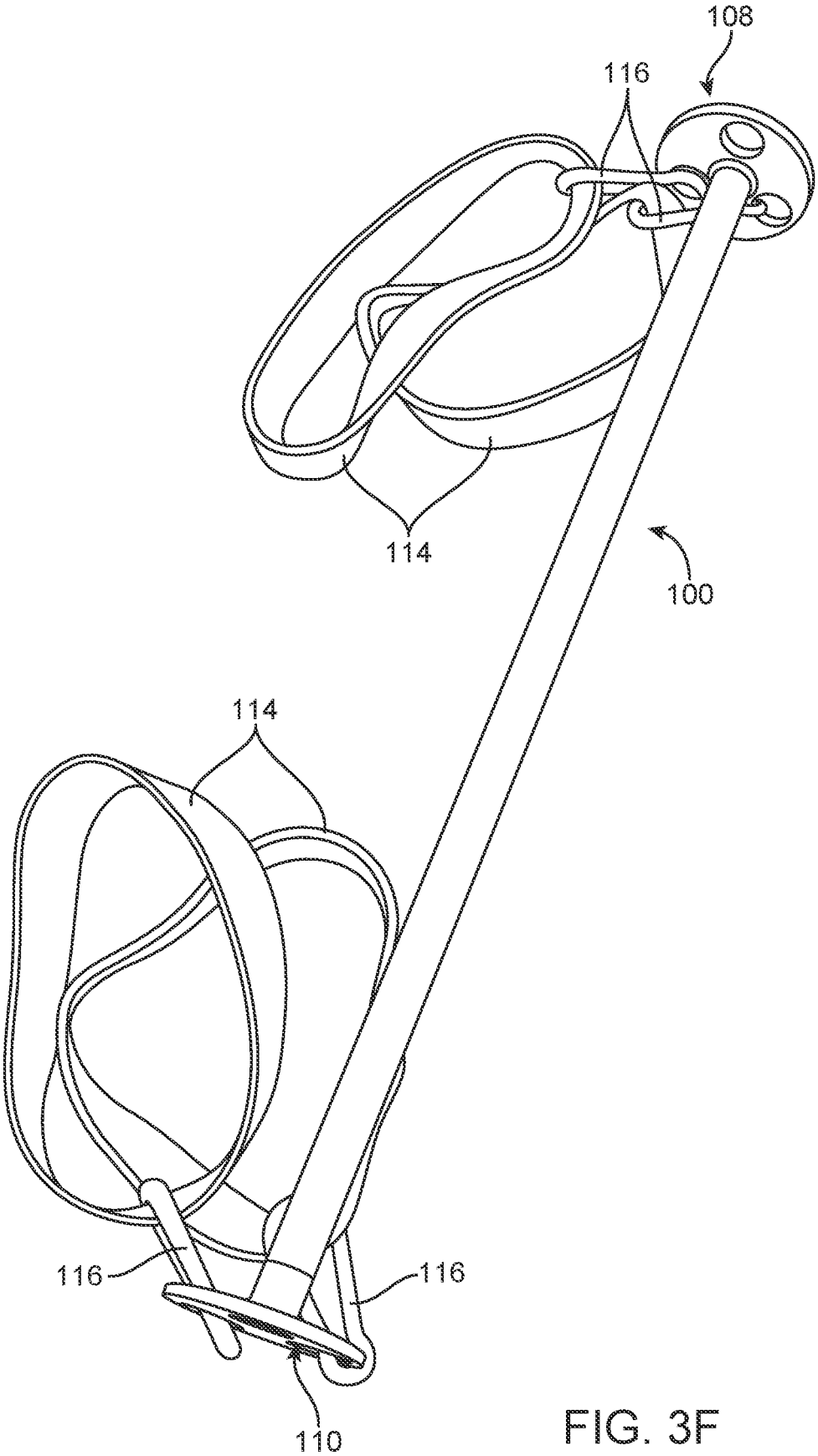
Figure 3G:
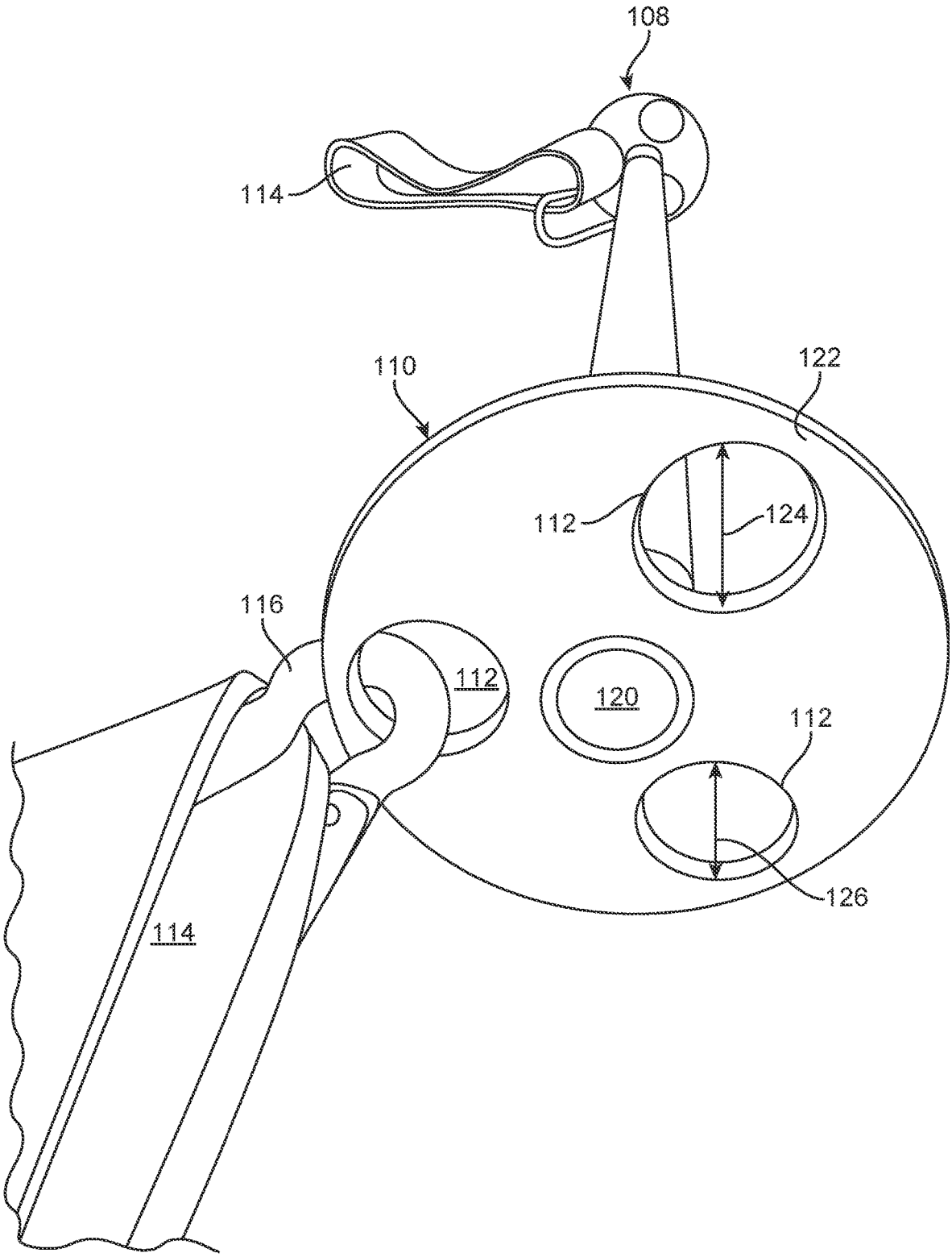
Figure 3H:
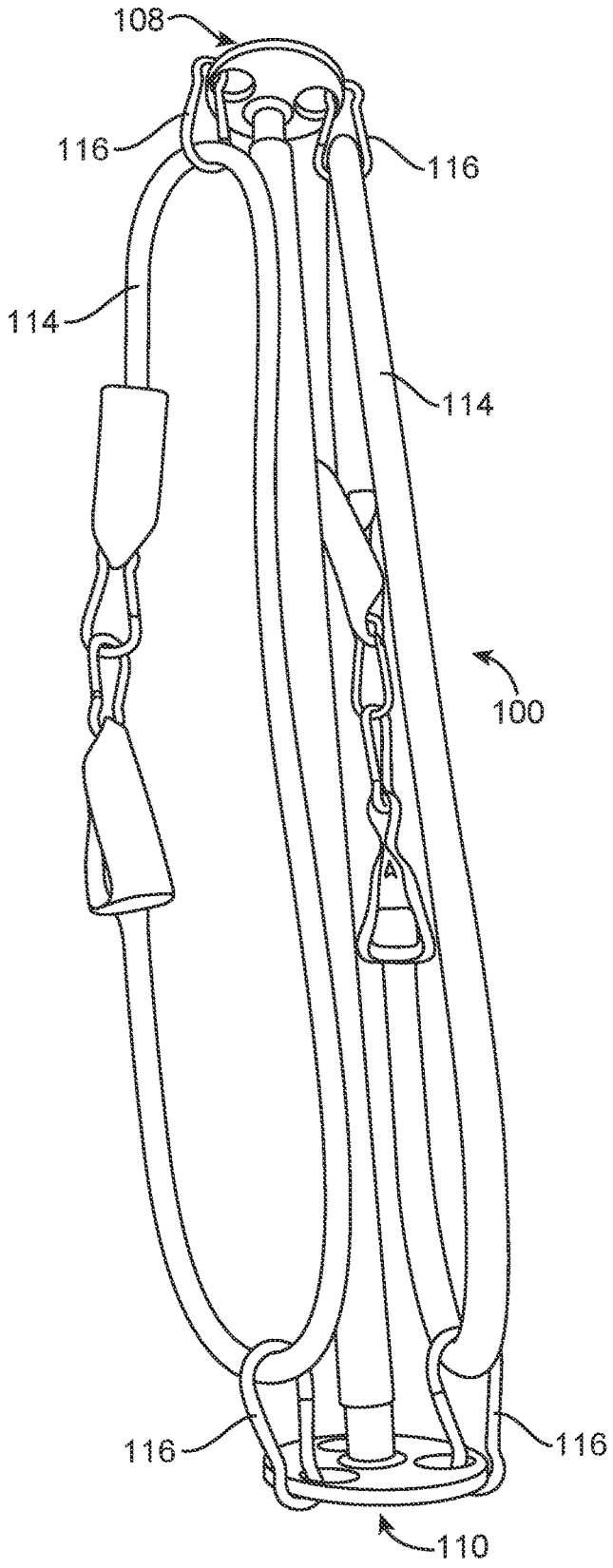

As indicated above, coupler 116 may be any number of connectors such as clips, carabiner, etc. As best shown in FIGS. 1J, 3F, and 3H, multiple openings enable use of multiple resistance bands. For example, a first resistance 114 band of first resistance level may be attached to a first opening 112 by a first coupler 116. A second resistance band 114 with a second resistance level attached to a second opening 112 by a second coupler 116. A Third resistance band 114 with a third resistance level attached to a third opening 112 by a third coupler 116. Alternatively, given the large diameter size of openings 112 (e.g., 1 inches for example), a single opening 112 may easily accommodate multiple couplers 116, with each coupler 116 having a resistance band 114. In addition, a single opening 112 may accommodate multiple couplers 116, with each coupler having multiple resistance bands 114. According, the number of permutation and combination of the number and types resistance bands 114 used may vary greatly. Also, users may simply "hang" multiple resistance bands 114 by a coupler 116 onto resistance based exercise device 100 (FIG. 3H) for easy transport (FIG. 2) due to the compact form-factor and ease of attachment and detachment of device 100 and couplers 116, even if only one resistance band 114 would be used for an exercise routines.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, first and second engagement plates 108 and 110 may each include only one opening. For example, first and second engagement plates 108 and 110 may each include only two openings 180-degree separation. For example, first and second engagement plates 108 and 110 may each include only two openings 90-degree separation. Such variations and alternate embodiments are contemplated, and can be made without departing from the spirit and scope of the invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction, orientation, or position. Instead, they are used to reflect relative locations/positions and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

Further the terms "a" and "an" throughout the disclosure (and in particular, claims) do not denote a limitation of quantity, but rather denote the presence of at least one of the referenced item.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A resistance-based exercise device, comprising:
a single, integral piece having:
a bar having a first distal end and a second distal end;
a first engagement plate fixed to the first distal end; and
a second engagement plate fixed to the second distal end;
the first and the second engagement plates are comprised of a flat, rounded piece configured as a circular disk, with each disk having a center fixed to the first and second distal ends of the bar;
the first and the second engagement plates have;
three rounded circular openings with equal diameters for detachably engaging one or more resistance bands of varying resistance level by a coupler;
the openings have 120-degree separation, having an equal radial distance from the center, and are uniformly disposed between the center, disk peripheral edge, and one another.

2. The resistance-based exercise device as set forth in claim 1 wherein:
the bar has a compact form factor, comprised of an elongated, cylindrical piece.

3. The resistance-based exercise device as set forth in claim 1 wherein:
the coupler detachably engaged with an opening of the three openings freely slides within the opening during a range of motion of exercise.

4. The resistance-based exercise device as set forth in claim 1 wherein:
the first engagement plate and the second engagement plate are oriented perpendicular a longitudinal axis of the bar.

5. The resistance-based exercise device as set forth in claim 1 wherein:
the first engagement plate and the second engagement plate are parallel, with orientation of the three openings perpendicular to a longitudinal axis of the bar.

6. A compact bar apparatus, comprising:
a metal barbell;
a first and a second metal disks that include a center that is welded to each distal end of the barbell;
the first and the second metal disks have three rounded circular openings with equal diameters;
the openings have 120-degree separation, having an equal radial distance from the center, and are uniformly disposed between the center, disk peripheral edge, and one another;
a resistance band;
a coupler detachably engaged with the resistance band;
wherein: the coupler with the engaged resistance band is detachably attached through one of the three openings of the first and the second metal disks.

7. A resistance-based exercise device, consisting of:
a single, integral piece that having:
an elongated cylindrical bar that has a first distal end and a second distal end;
a first engagement plate includes:
a first flat, rounded piece configured as a first circular disk having a first center fixed to the first distal end of the bar;
the first disk includes:
a first set of three rounded circular openings with equal diameters that are uniformly disposed on the first disk, with the uniform disposition of the first set of the three openings having:
120-degree separations and an equal radial distance from the center; and a second engagement plate includes:

a second flat, rounded piece configured as a second circular disk having a second center fixed to the second distal end of the bar;

the second disk includes:

a second set of three rounded circular openings with equal diameters that are uniformly disposed on the second disk, with the uniform disposition of the second set of the three openings having:

120-degree separations and an equal radial distance from the center.

* * * * *